United States Patent [19]

Smith et al.

[11] 3,949,927

[45] Apr. 13, 1976

[54] IMPACT RESISTANT CONTAINER BOTTOM STRUCTURE

[75] Inventors: Ernest L. Smith, Kansas City, Mo.; Wayne E. Maw, Freeport, Ill.; George E. MacEwen, Kansas City, Mo.

[73] Assignee: Phillips Petroleum Company, Bartlesville, Okla.

[22] Filed: Mar. 21, 1975

[21] Appl. No.: 560,608

[52] U.S. Cl. ..... 229/14 BL; 229/3.1; 229/4.5; 229/5.5; 229/48 T; 229/51 WB

[51] Int. Cl.[2] ..... B65D 5/40; B65D 5/56

[58] Field of Search ..... 229/5.5, 4.5, 14 BL, 21, 229/3.1, 48 T, 5.6, 51 WB; 156/289; 428/352

[56] References Cited

UNITED STATES PATENTS

| | | | |
|---|---|---|---|
| 1,926,941 | 9/1933 | Gomes | 229/23 |
| 2,082,995 | 6/1937 | Wilcox | 229/14 |
| 2,874,888 | 2/1959 | Horning et al. | 229/5.6 |
| 3,137,431 | 6/1964 | Crous et al. | 229/4.5 X |
| 3,182,882 | 5/1965 | Aellen, Jr. et al. | 229/4.5 |
| 3,292,842 | 12/1966 | Huang et al. | 229/17 |
| 3,722,780 | 3/1973 | MacEwen | 229/176 |
| 3,851,813 | 12/1974 | Smith | 229/176 |

*Primary Examiner*—William Price
*Assistant Examiner*—Stephen P. Garbe

[57] ABSTRACT

A container has a tubular sidewall member having a coating of thermoplastic material on the inner surface thereof and a bottom member having a coating of thermoplastic material on the upper surface thereof. The bottom member has a central portion and a continuous skirt extending downwardly from the periphery of the central portion. The lower portion of the skirt is thermally bonded to the sidewall member while the upper portion of the skirt is free of any bond to the sidewall member. The bottom margin of the sidewall member can be curled inwardly to form a rolled rim to improve the impact resistance. In one embodiment the sidewall blank can have a coating of adherence-preventing material in the area which would be contiguous to the upper portion of the skirt. In another embodiment the upper portion of the skirt can be coated with an adherence-preventing material.

14 Claims, 7 Drawing Figures

IMPACT RESISTANT CONTAINER BOTTOM STRUCTURE

This invention relates to packaging containers and blanks therefor. In one aspect the invention relates to a container having an impact resistant bottom structure. In another aspect the invention relates to a bottom blank and/or sidewall blank for making a container with an input resistant bottom structure.

The use of polyethylene coated paperboard for the construction of packaging containers wherein the various components are thermally bonded together has become extensive in recent years. However, the polyethylene-polyethylene bond is generally stronger than the polyethylene-paperboard bond in such containers, and any significant impact force on the container can cause delamination of the polyethylene coating from the paperboard in the thermally bonded areas, thereby exposing the paperboard to the contents of the container. Many materials which are packaged in such containers will affect the strength of the paperboard if the paperboard is exposed to the contents of the container, for example liquids such as grape juice, milk, detergents, and the like.

In accordance with the present invention this problem is minimized, if not eliminated, by bonding the lower portion of the skirt of the botton member to the sidewall member while leaving the upper portion of the skirt unbonded. The impact resistance of the bottom structure can be enhanced by curling the botton margin of the sidewall member inwardly and upwardly against the bottom member.

Accordingly, it is an object of the invention to provide a new and improved container. It is an object of the invention to provide a container having an impact resistant bottom structure. Another object of the invention is to maintain the liquid-tight integrity of a container when the container is subjected to impact force. Yet another object of the invention is to provide a sidewall blank for the construction of a container having an impact resistant bottom structure. A further object of the invention is to provide a bottom blank for the construction of a container having an impact resistant bottom structure. Other objects, aspects and advantages of the invention will be apparent from a study of the specification, the drawings and the appended claims to the invention.

Figure 2:
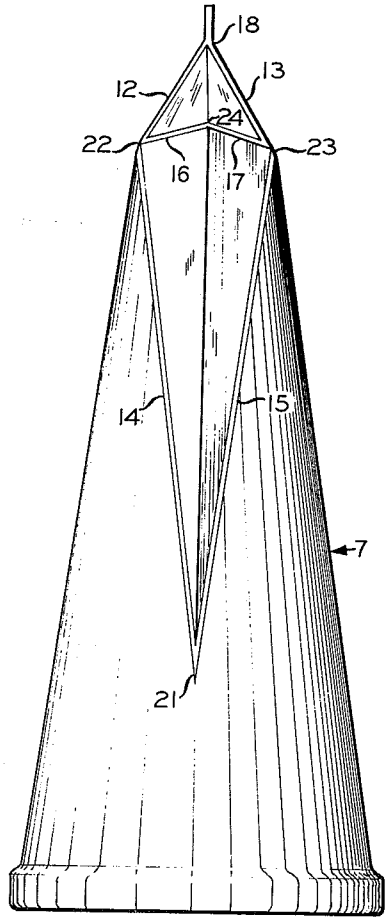
FIG. 2 is a side elevational view of the container of FIG. 1.
Figure 1:
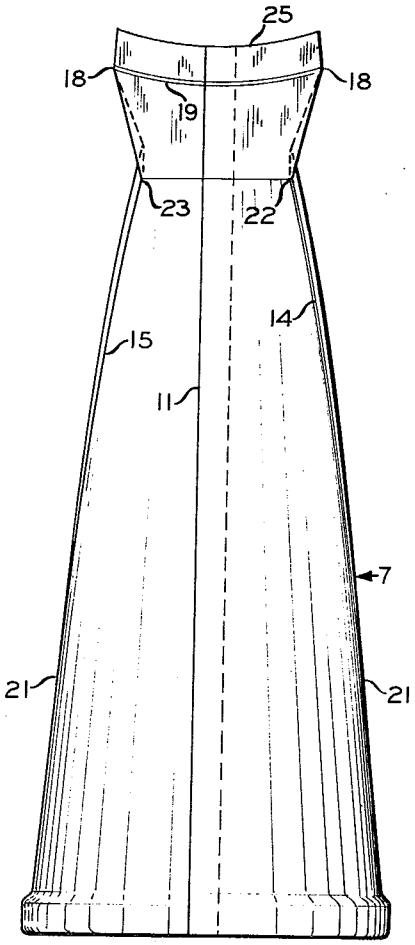
FIG. 1 is a front elevational view of a container incorporating one embodiment of the present invention.

Referring now to the drawings in detail and to FIGS. 1 and 2 in particular, the illustrated container is a generally frustoconical container having a pinched waist configuration of the type disclosed in E. L. Smith, U.S. Pat. No. 3,851,813, issued Dec. 3, 1974. The disclosure of U.S. Pat. No. 3,851,813 is incorporated herein in its entirety by reference. The sidewall 7, formed of a layer 8 of a paperlike fibrous material, such as paperboard, having an outer coating 9 and an inner coating 10 of a suitable thermoplastic material on the outer and inner surfaces thereof, have been convoluted and the overlapping side margins have been thermally bonded to each other to form a frustoconical preform having a side seam 11. Two pinched waist forming score-line configurations are spaced apart approximately 180° on the preform, with each comprising a first pair of score lines 12 and 13, a second pair of score lines 14 and 15, and a third pair of score lines 16 and 17. Score lines 12 and 13 extend downwardly from point 18 on lateral score line 19. Score lines 14 and 15 extend upwardly and outwardly from point 21 which is spaced upwardly from the bottom of sidewall 7. Score line 14 intersects score line 12 at point 22, while score line 15 intersects score line 13 at point 23 to form a tetragon. Score lines 16 and 17 converge upwardly from points 22 and 23 to intersection point 24. The folding of the sidewall material along the score lines of the pinched waist score-line configuration results in points 22, 22, 23 and 23 being moved away from the longitudinal axis of the container and the changing of the circular configurations of top edge 25 and score line 19 into elongated configurations. The inner faces of the ridge panels formed between score line 19 and top edge 25 are thermally bonded together to seal the top of the container.

Figure 3:
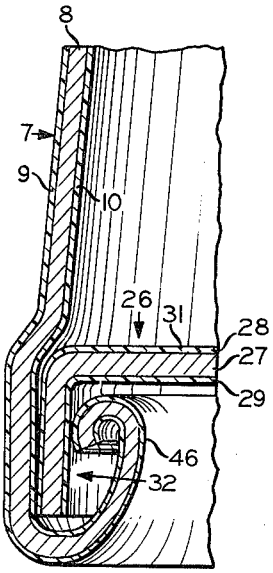
FIG. 3 is a fragmentary elevational view in cross section of the bottom structure of the container of FIG. 1.

Referring now to FIG. 3, either before or after the sealing of the top structure of the container, a bottom member 26 is inserted into the open bottom end of the frustoconical preform and is thermally bonded to the sidewall. In accordance with the present invention the bottom member 26 is formed of a suitable paper-like fibrous material, for example paperboard. In the embodiments of the invention illustrated in FIG. 3, the bottom member 26 is composed of a paperboard layer 27 having a coating 28 of a suitable thermoplastic material on the upper face thereof and a coating 29 of a suitable thermoplastic material on the lower face thereof. While any suitable thermoplastic material can be employed for coatings 9, 10, 28 and 29, a normally solid polymer of at least one monoolefin is presently preferred, with an example thereof being a polymer of ethylene. The bottom member 26 has a central discoidal area 31, having a diameter approximately equal to the inner diameter of the corresponding portion of the container sidewall 7, and an outer annular flange or skirt 32 extending continuously around the periphery of the central discoidal area 31 and being inclined downwardly from the periphery of the central discoidal area 31 in general conformity to the adjacent portion of the sidewall 7. In prior art containers wherein a flanged discoidal bottom member is inserted into the open end of a tubular sidewall and thermally bonded thereto, the bond is effected throughout at least substantially the entire height of the flange. However, in accordance with the present invention, the thermal bond of the skirt 32 to the inner surface of sidewall 10 is effected only in the lower portion 33 of the skirt 32, leaving the upper portion 34 of skirt 32 adjacent to but not bonded to sidewall 10. While the ratio of the height of the lower bonded portion 33 of skirt 32 to the height of the upper unbonded portion 34 of skirt 32 will depend upon the size of the container, the strength of the thermal bond required and the magnitude of the impact force for which protection is desired, this ratio will generally be in the range of about 1:3 to about 3:1, preferably in the range of about 1:2 to about 2:1, and more preferably in the range of about 1:1.5 to about 1.5:1.

Figure 5:
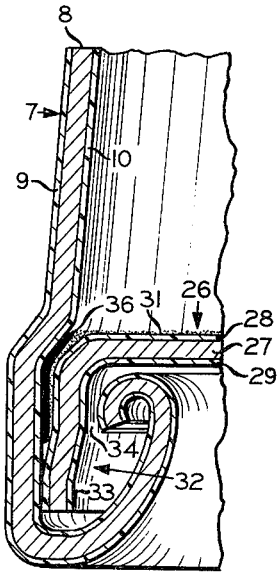
FIG. 5 is a fragmentary elevational view in cross section of the bottom structure of a container incorporating another embodiment of the invention.
Figure 7:
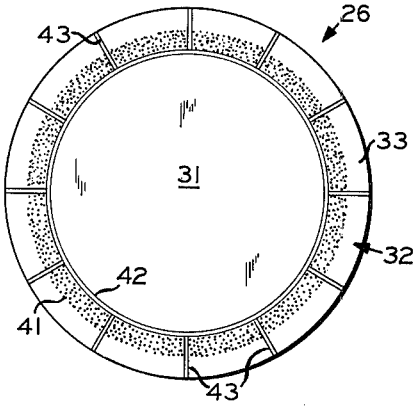
FIG. 7 is a plan view of a bottom disc blank in accordance with yet another embodiment of the invention.
Figure 6:
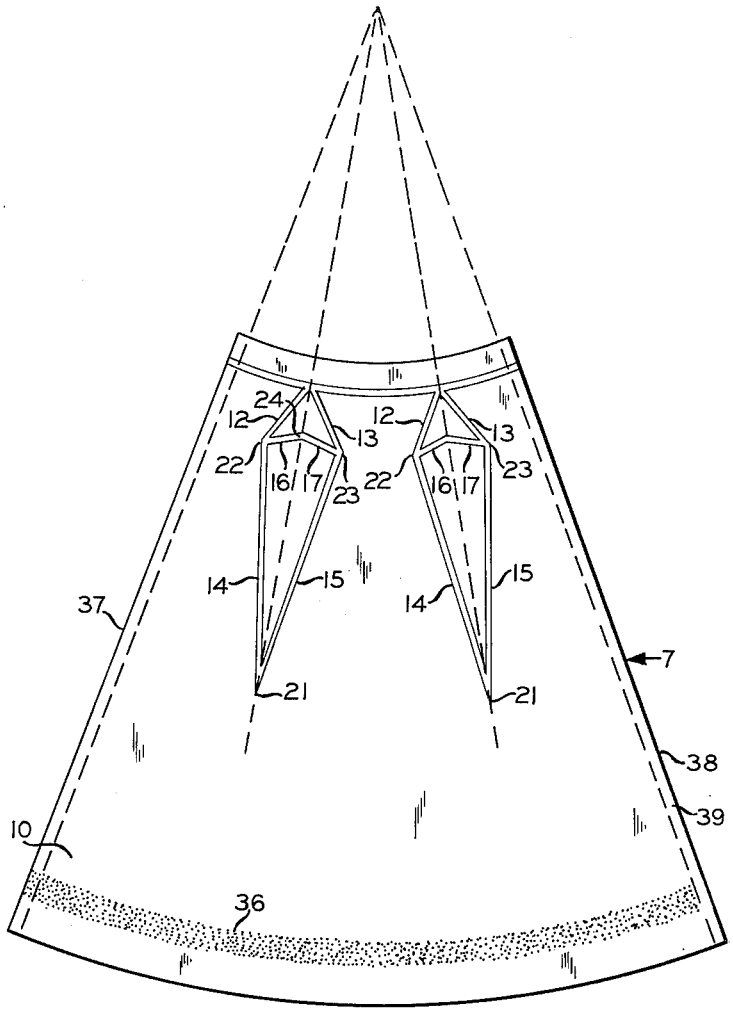
FIG. 6 is a plan view of the inside surface of a sidewall blank for making the container of FIG. 5.

This selective bonding of only the lower portion 33 of skirt 32 to the sidewall 7 can be accomplished with any suitable technique. In one embodiment a cooling means can be positioned within the opening formed by skirt 32 and horizontally adjacent to the upper portion 34 while a heating means can be positioned horizontally adjacent to the lower portion 33, thereby permitting the temperature of the thermoplastic coating 28 on the lower portion 33 of skirt 32 to be raised to a thermal bonding temperature while the temperature of the thermoplastic coating 28 on the upper portion 34 of skirt 32 is maintained below the minimum thermal bonding temperature. In another embodiment illustrated in FIGS. 5 and 6, a layer 36 of adherence-preventing material is applied as the outermost layer over the thermoplastic coating 10 on the inside surface of sidewall 7 throughout the area which is to be in contact with the upper portion 34 of flange 33. Thus, the layer 36 extends from one side edge 37 of the sidewall blank to the other side edge 38 of the sidewall blank except for the side margin 39 which is overlapped in the formation of the side seam 11. The layer 36 extends upwardly from the upper edge of the bottom portion 33 to at least level with, and preferably higher than the upper surface of the central discoidal portion 31 of bottom member 26, to prevent any thermal bonding of upper portion 34 to the sidewall 7. In another embodiment an annular layer 41 of adherence-preventing material is applied to the bottom member 26 as the uppermost layer in upper portion 34, as shown in FIG. 7. The bottom member 26 and the central discoidal area 31 can have concentric circular configurations. The bottom member 26 can be provided with an annular score line 42 defining the junction between the central discoidal area 31 and skirt 32. A series of score lines 43 can extend radially outwardly from score line 42 to the periphery of bottom member 26 to promote uniformity in the folds formed in skirt 32 when the bottom member 26 is bent along score line 42 to cause skirt 32 to extend downwardly from the peripheral edge of central discoidal area 31. The layer 41 extends outwardly from the periphery of central discoidal area 31 defined by groove 42 to the line of demarkation between lower portion 33 and upper portion 34 of skirt 32. The adherence-preventing material can be any suitable material which can be coated onto the thermoplastic coating 10 of sidewall 17 or the thermoplastic coating 28 of bottom member 26 and which will subsequently prevent thermal bonding with the thermoplastic coating 28 or 10, respectively. Examples of suitable adherence-preventing coating materials include, but are not limited to, cellophane; metal foils; and thermosetting resins, such as heat resistant latex water varnish, catalyzed epoxy material, fluorocarbon material, and various nitrocellulose materials formulated from a base nitrocellulose resin and a plasticizer.

Figure 4:
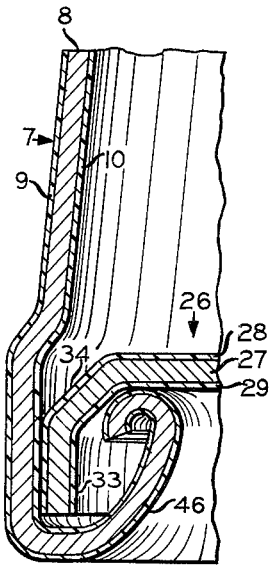
FIG. 4 is a fragmentary elevational view corresponding to FIG. 3 after the container has been subjected to an impact force on its bottom edge.

Referring now to FIG. 4, the container of FIGS. 1–3 has been subjected to an impact force on the bottom edge of the container by the container having been dropped onto the floor. The weight of the contents of the container caused the deformation of bottom member 26 upon impact, by forcing the central discoidal area 31 downwardly, bending the upper portion 34 of skirt 32 inwardly away from the sidewall 7. However, the liquid-tight seal between the lower portion 33 of skirt 32 and sidewall 7 remains intact. As a result of upper portion 34 of skirt 32 not being bonded to the sidewall 7, there was no delamination of thermoplastic coating 10 from paperboard 8 and/or delamination of thermoplastic coating 28 from paperboard 27 which would have occurred if upper portion 34 had been thermally bonded to sidewall 7. Such delamination would have exposed the paperboard to the contents of the container, substantially reducing the serviceability of the container for packaging any material which would adversely affect the paperboard.

In the presently preferred embodiments of the invention, the bottom margin 46 of sidewall 7, which is the portion of sidewall 7 extending beyond the lower edge of skirt 32, is rolled inwardly and upwardly to form a rolled rim extending above the upper edge of bottom portion 33 and preferably at least closely adjacent, and more preferably in contact with, the lower surface of central discoidal area 31. This rolled rim serves as a shock absorber for the central discoidal area 31, minimizing the effects of the impact on central discoidal area 31. The rolled rim has at least 180°, preferably at least 270° and more preferably at least 360°, of curvature.

While the invention has been described in terms of a frustoconical container having a larger base than top, the invention is also applicable to other types of containers having an at least generally upstanding tubular sidewall member, including cylindrical containers, containers having an oval cross section in a plane perpendicular to the longitudinal axis of the container, frustoconical containers having a larger top than base, rectangular containers, containers with a base of at least five sides, etc. In each such container the bottom member will be positioned in the opening formed by the lower portion of the tubular sidewall member, and the central portion of the bottom member will have a configuration at least substantially conforming to the cross-sectional configuration of the inner surface of the tubular sidewall member at the level of the central portion of the bottom member. When it is desirable to employ the rolled rim 46 on a container which has a polygonal base, the portion of the sidewall 7 below the bottom edge of skirt 32 can be notched to form tabs which correspond in length and location to the polygonal base, and these tabs can then be curled inwardly and upwardly to form the rolled rim 46 without interference from each other at the corners of the base. The container sidewall member and/or the bottom member can be provided with additional coatings between the layer of paper-like fibrous material and the layer of thermoplastic material utilized to effect the heat seal. For example either or both of these members can be lined with a metal foil, such as aluminum foil. Other reasonable variations and modifications are possible within the scope of the foregoing disclosure, the drawings and the appended claims to the invention.

That which is claimed is:

1. A container having a generally upstanding tubular sidewall member and a bottom member, the lower portion of said tubular sidewall member forming an opening, said bottom member being positioned within said opening formed by the lower portion of said tubular sidewall member, said bottom member having a central portion and a skirt, said central portion having a configuration at least substantially conforming to the cross-sectional configuration of the inner surface of said tubular sidewall member at the level of said central portion, said skirt extending completely around the periphery of said central portion and being inclined generally downwardly from the periphery of said central portion and having a lower portion and an upper portion, said tubular sidewall member having a coating of a thermoplastic material on at least the inner surface thereof, said bottom member being formed of a paper-like fibrous material with the upper surface of said central portion and the outer surface of said skirt contiguous to said sidewall member having a coating thereon of a thermoplastic material, said lower portion of said skirt and the portion of sidewall member contiguous thereto being adhered together by a thermal bonding of the coating of thermoplastic material on said lower portion of said skirt and the coating of thermoplastic material on the inside surface of said sidewall member, the coating on said outer surface of said upper portion of said skirt being free of adherence to the coating on the inside surface of said tubular sidewall member.

2. A container in accordance with claim 1 wherein the ratio of the height of said lower portion of said skirt to the height of said upper portion of said skirt is in the range of about 1:3 to about 3:1.

3. A container in accordance with claim 1 wherein said tubular sidewall member has a bottom margin portion projecting beyond the lower edge of said skirt, said bottom margin portion extending inwardly and upwardly to form a rolled rim extending above the upper edge of said lower portion of said skirt and having at least 180° curvature.

4. A container in accordance with claim 3 wherein said rolled rim extends upwardly within the opening formed by said skirt to at least closely adjacent the lower surface of said central portion and has at least 270° curvature.

5. A container in accordance with claim 3 wherein said rolled rim extends upwardly within the opening formed by said skirt to contact the lower surface of said central portion.

6. A container in accordance with claim 5 wherein said rolled rim has at least 360° curvature.

7. A container in accordance with claim 6 wherein the ratio of the height of said lower portion of said skirt to the height of said upper portion of said skirt is in the range of 1:2 to 2:1.

8. A container in accordance with claim 7 wherein said container has a circular cross section in a plane perpendicular to the longitudinal axis of the container.

9. A container in accordance with claim 8 wherein at least one of said upper portion of said skirt and the portion of said sidewall member contiguous thereto has an outermost coating of a material which prevents the adherence of said upper portion of said skirt to the portion of said sidewall member contiguous thereto.

10. A container in accordance with claim 1 wherein at least one of said upper portion of said skirt and the portion of said sidewall member contiguous thereto has an outermost coating of a material which prevents the adherence of said upper portion of said skirt to the portion of said sidewall member contiguous thereto.

11. A blank for forming the bottom member of a container, said blank being formed of a lower layer of a paper-like fibrous material and an upper layer of thermoplastic material, said blank having a central portion and a skirt extending completely around the periphery of said central portion, said skirt having a first portion and a second portion, said first portion extending outwardly from the periphery of said central portion to said second portion, said second portion extending outwardly from the periphery of said first portion to the periphery of said blank, said first portion having as the uppermost surface thereof a layer of material which would prevent the thermal bonding of said uppermost surface to a surface of a thermoplastic material.

12. A blank in accordance with claim 11 wherein said central portion and said skirt meet at a first score line.

13. A blank in accordance with claim 12 wherein said blank and said central portion have concentric circular configurations, and further comprising a plurality of spaced score lines extending radially outwardly from said first score line to the periphery of said blank.

14. A blank for forming the sidewall member of a tubular container, said blank being formed of a lower layer of a paper-like fibrous material and an upper layer of thermoplastic material, said blank having top and bottom edges and first and second side edges and being adapted to be convoluted into a tubular shape with the margin along said first side edge overlapping the margin along said second side edge, a coating superimposed on a portion of said upper layer of thermoplastic material in the form of a band adjacent to and spaced from said bottom edge extending from said first side edge up to the margin along said second side edge, said coating being a material which would prevent the thermal bonding of said coating to a surface of a thermoplastic material.

* * * * *